US007260927B2

(12) United States Patent
Hsu

(10) Patent No.: US 7,260,927 B2
(45) Date of Patent: Aug. 28, 2007

(54) INTELLIGENT, FULL-FEATURED DIESEL ENGINE EXHAUST TREATMENT SYSTEM

(75) Inventor: Paul Hsu, Chung-Ho (TW)

(73) Assignee: Trivision Technology Taiwan Co., Ltd., Chung-Ho (TW)

( * ) Notice: Subject to any disclaimer, the term of this patent is extended or adjusted under 35 U.S.C. 154(b) by 0 days.

(21) Appl. No.: 10/885,502

(22) Filed: Jul. 6, 2004

(65) Prior Publication Data

US 2005/0066651 A1 Mar. 31, 2005

(30) Foreign Application Priority Data

Jul. 8, 2003 (TW) ..... 92118615 A

(51) Int. Cl.
*F01N 3/00* (2006.01)
*F01N 3/02* (2006.01)

(52) U.S. Cl. ..... 60/288; 60/297; 60/311

(58) Field of Classification Search ..... 60/295, 60/297, 272, 323, 311
See application file for complete search history.

(56) References Cited

U.S. PATENT DOCUMENTS

| | | | | |
|---|---|---|---|---|
| 3,656,915 | A * | 4/1972 | Tourtellotte | 422/171 |
| 4,665,689 | A * | 5/1987 | Rognon | 60/277 |
| 5,531,068 | A * | 7/1996 | Kass et al. | 60/274 |
| 5,603,216 | A * | 2/1997 | Guile et al. | 60/288 |
| 5,701,735 | A * | 12/1997 | Kawaguchi | 60/274 |
| 6,164,065 | A * | 12/2000 | Denari et al. | 60/284 |
| 6,212,885 | B1 * | 4/2001 | Hirota et al. | 60/288 |
| 6,405,527 | B2 * | 6/2002 | Suzuki et al. | 60/285 |

FOREIGN PATENT DOCUMENTS

| | | |
|---|---|---|
| TW | 324467 | 4/1986 |
| TW | 373688 | 9/1986 |
| TW | 362709 | 10/1987 |
| TW | 392797 | 10/1987 |
| TW | 434367 | 5/2001 |
| TW | 500870 | 9/2002 |
| TW | 561431 | 11/2003 |
| TW | 570097 | 1/2004 |
| TW | 584665 | 4/2004 |
| TW | 587655 | 5/2004 |

OTHER PUBLICATIONS

English Abstract of TW 587655 dated May 11, 2004.
English Abstracts of TW 570097 dated Jan. 1, 2004.
English Translation of German Unikat Combifilter V 2×18 equipment diagram.

* cited by examiner

*Primary Examiner*—Thomas Denion
*Assistant Examiner*—Loren Edwards
(74) *Attorney, Agent, or Firm*—Ladas and Parry LLP

(57) ABSTRACT

Disclosed is an intelligent, full-featured diesel engine exhaust treatment system, including: an exhaust flowing zone, a microcomputer processor, and an exhaust detecting device, the exhaust flowing zone defining a first exhaust treatment path and a second exhaust treatment path, the microcomputer processor selectively employing a soot filter and a catalyst converter to purify the engine exhaust based on the state of contaminants in the engine exhaust as detected by the exhaust detecting device.

17 Claims, 3 Drawing Sheets

INTELLIGENT, FULL-FEATURED DIESEL ENGINE EXHAUST TREATMENT SYSTEM

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

This invention relates to an intelligent, full-featured diesel engine exhaust treatment system to be implemented in a power generator or dynamic UPS.

2. Background

Diesel engine exhaust treatment system is a technology that has been widely implemented in the industry, and is mainly implemented in filtering and treating two types of exhaust, including: (1) soot particles (particle contaminants); and (2) a mixture of hydrocarbons and carbon monoxides (gaseous contaminants). For example, TW324467Y disclosed an exhaust treatment apparatus, including a hollow container; a filter assembly coated with catalyst to a surface thereof and formed with an intake compartment; a retaining bracket; a heater capable of generating heat; and an intake pipe consisting of a long tube and a short tube. In such an exhaust treatment apparatus, the exhaust is introduced into the intake compartment after entering the intake pipe, and then passes through passageways of the filters located at opposing sides to achieve the intended filtering effects. The filtered exhaust is then discharged into the atmosphere through a passageway which communicates an opening defined by the retaining bracket, the container and the filter assembly.

TW362709Y disclosed a regeneration smoke filtering apparatus for diesel engine, including a heat generating device provided at an upstream of the filtering apparatus, and a blower provided at an upstream of the heat generating device, wherein the heat generating device is constructed of a support body and plural ceramic heaters, and the tank body is formed with an intake port and plural openings for retaining the ceramic heaters.

TW373688Y disclosed an improved exhaust pipe, including an elbow pipe connected to the exhaust pipe to form two outlets, wherein one of the outlets is connected to a filter for filtering particle contaminants. Such an exhaust implements a diversion board in a muffler to spin the exhaust in the lining. When the filtering apparatus is gradually blocked, rendering the exhaust pressure in the elbow pipe to reach the threshold limit value of the pressure valve, the pressure valve would be released automatically to direct most of the exhaust into the muffler through the pressure valve and the elbow pipe.

In addition, TW392797Y disclosed an improved smoke filter for diesel, including a smoke filter and a butterfly valve, the butterfly valve having a tube, a rod, a cylinder, a valve seat and link rod and a retaining block, wherein the valve seat is driven to be rotated by the rotation of the link rod, and the tube of the buttery valve is directed into a passageway in a filter element of the smoke filter.

Generally speaking, a soot filter serves to filter soot particles and mostly adopts porous ceramic filter medium and is formed with a honeycombed inlet and a honeycombed outlet. Accordingly, after the soot exhaust enters the honeycombed passageway through the inlet, the soot particles cannot pass through the thin wall of the filter medium and are thus captured by the filter medium to achieve the intended filtering effects. Even though such soot filters can indeed achieve the intended filtering effects, such a conventional measure of treating engine exhaust by filters involves the shortcomings that, (1) the soot filters can only filter soot and the filter medium requires frequent regeneration and cleaning, such that they cannot accommodate to the extended operation of engines; and (2) the pressure drop resulted from the ceramic filter element configured of such honeycombed walls is relatively high, and the cost for installing a system having a large number of conventional soot filters is about 5 to 15 folds of that using catalyst converters.

A catalyst converter serves to treat hydrocarbons and carbon monoxides. The conventional structure is to coat catalyst over the surface of the ceramic or metal filter element to reduce the combustion temperature of carbon monoxides and hydrocarbons, such that the engine exhaust temperature alone is sufficient enough to convert the contaminants in the exhaust into water and carbon dioxides. However, the use of the conventional catalyst converter alone to treat engine exhaust also involves the shortcomings that (1) the inability of treating the large amount of soot that is instantaneously generated in starting the engine, and (2) the inability of treating hydrocarbons and carbon monoxides that is generated by the engine when the exhaust temperature is at a low temperature, such as less than 250° C.

In view of the above, the conventional art mostly implements soot filters alone to treat soot particles, or catalyst converters alone to treat the mixture of hydrocarbons and carbon monoxides, or soot filters coated with catalyst alone to treat soot particles, carbon monoxides and hydrocarbons. However, neither the use of soot filters (coated with catalyst) nor catalyst converters alone can economically or effectively treat engine exhaust containing soot particles, hydrocarbons and carbon monoxides. Accordingly, there is a need to provide an exhaust treatment system capable of automatically detecting the state of exhaust contaminants to allow selective implementation of soot filters and catalyst converters.

SUMMARY OF INVENTION

It is an object of this invention to provide an intelligent, full-featured diesel engine exhaust treatment system to be implemented in a power generator or a dynamic UPS to overcome the shortcomings of the conventional art. Such an intelligent, full-featured diesel engine exhaust treatment system makes improvements to the conventional soot filters and catalyst converters by integrating the two into a system to optimize the exhaust treatment effects and the economic effects.

According to this invention, the intelligent, full-featured diesel engine exhaust treatment system includes: an exhaust flowing zone, a microcomputer processor, and an exhaust detecting device provided between the exhaust flowing zone and the microcomputer processor.

The exhaust flowing zone includes: an intermediate communicating pipe, at least one lower collection tube, at least one catalyst converter array, at least one intermediate collection tube, at least one soot filter array, at least one upper collection tube, a main exhaust pipe, and a muffler, wherein these components are directly or indirectly in communication with each other to define a first exhaust treatment path and a second exhaust treatment path. The first exhaust treatment path passes through the at least one soot filter array, or passes through the at least one catalyst converter array and the at least one soot filter array at the same time. The second exhaust treatment path passes through the at least one catalyst converter array.

According to this invention, the exhaust detecting device is provided in the exhaust treatment paths to allow omni-bearing detection of the exhaust data discharged by the engine, such as temperature, pressure, flow rate, light impermeability, and the existence of hydrocarbons, carbon monoxides, sulfides, and nitrides. The microcomputer processor would then determine the state of contaminants in the engine exhaust based on the exhaust data to transmit a command for selecting an appropriate exhaust treatment path which can optimize the treatment effects, Such that the soot particles, hydrocarbons and carbon monoxide in the engine exhaust can pass through the soot filters and catalyst converters, respectively, for proper treatment.

Preferably, the soot filters are heating soot filters which allow automatic regeneration, and the catalyst converters are low temperature catalyst converters. The heating soot filters, feature the advantages of highly efficient soot treatment and automatic regeneration of filter elements. The low temperature catalyst converters feature the advantages of low installation cost, zero operation cost, the ability of treating hydrocarbons, carbon monoxides and part of the soot under a low exhaust temperature, and the ability of continuous operation of the present invention integrates these two conventional devices in a system so as to optimize the treatment effects.

BRIEF DESCRIPTION OF THE DRAWINGS

These and other modifications and advantages will become even more apparent, from the following detailed description of a preferred embodiment of the invention and from the drawings in which.

DETAILED DESCRIPTION OF THE INVENTION (PREFERRED EMBODIMENTS)

Figure 1:
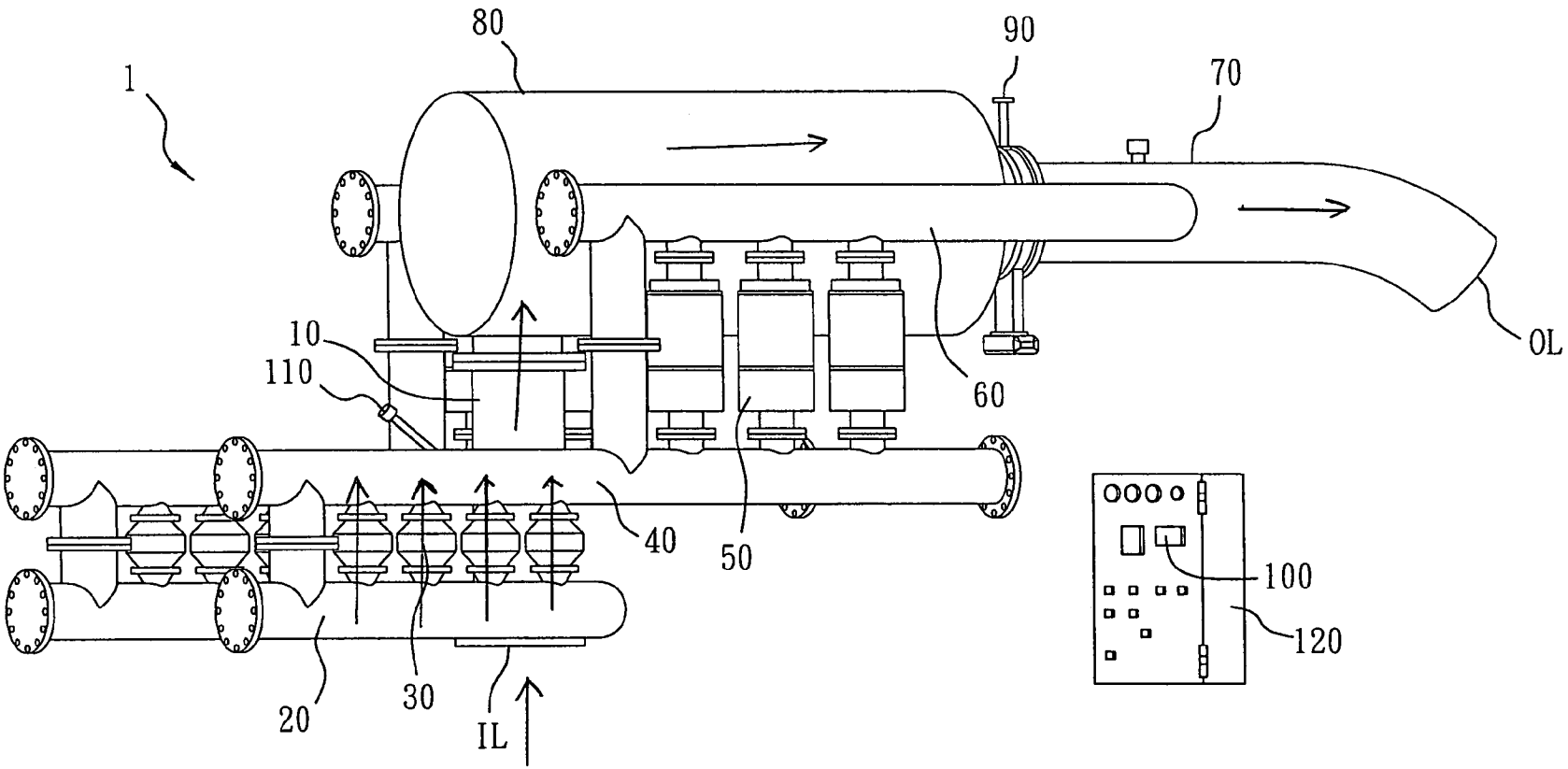
FIG. 1 is a schematic view illustrating an arrangement of an intelligent, full-featured diesel engine exhaust treatment system according to an embodiment of this invention in a horizontally symmetrical configuration.

FIG. 1 is a schematic view illustrating an arrangement of this invention in a horizontally symmetrical configuration. The intelligent, full-featured diesel engine exhaust treatment system 1 as illustrated generally includes an exhaust flowing zone constructed of plural components 10, 20 . . . , 80, which will be described later, a microcomputer processor 100, and an exhaust detecting device 110 provided between the exhaust flowing zone and the i microcomputer processor 100.

The exhaust flowing zone preferably includes: an intermediate communicating pipe 10, at least one lower collection tube 20, at least one catalyst converter array 30, at least one intermediate collection tube 40, at least one soot filter array 50, at least one upper collection tube 60, a main exhaust pipe 70, and a muffler 80.

The intermediate communicating pipe 10 includes an inlet IL connected to an engine outlet for receiving non-treated exhaust discharged by the engine. The at least one lower collection tube 20 establishes the communication between the intermediate communicating pipe 10 to the at least one catalyst converter array 30. The at least one intermediate collection tube 40 communicates the intermediate communicating pipe 10 to the at least one soot filter array 50. Accordingly, the intermediate communicating pipe 10 is in communication with the at least one catalyst converter array 30 or the at least one soot filter array 50. The catalyst converter array 30 is in communication with the soot filter array 50 through the intermediate collection tube 40 provided therebetween.

Each catalyst converter array 30 is preferably constructed of at least one low temperature catalyst converter to ensure ideal treatment effects in treating exhaust containing carbon monoxides and hydrocarbons. Each soot filter array 50 is preferably constructed of at least one heating soot filter array to ensure ideal exhaust treatment effects. In actual implementation, each catalyst converter array 30 preferably includes 1 to 20 low temperature catalyst converters, and each soot filter array 50 preferably includes 1 to 20 heating soot filters. In assembling the intelligent, full-featured diesel engine exhaust treatment system 1, the catalyst converter array 30 and soot filter array 50 are preferably arranged in a symmetrical manner, as shown in FIG. 1.

The at least one upper collection tube 60 communicates the at least one soot filter array 50 to the main exhaust pipe 70 for directing purified exhaust that has been treated by the soot filter array 50 into the main exhaust pipe 70. The muffler 80 has an end being in communication with the intermediate collection tube 40 the at least one catalyst converter array 30 through the intermediate communicating pipe 10 and the intermediate collection tube 40 to provide muffling effects.

Particularly, all components 10, 20, . . . 80 in the exhaust flowing zone jointly define a first exhaust treatment path A (see FIG. 2) and a second exhaust treatment path B (see FIG. 2) for treating exhaust of different contaminant levels. Both the first exhaust treatment path A and the second treatment path B extend between the intermediate communicating pipe 10 and the main exhaust pipe 70. As preferably shown in FIGS. 1 and 2, the first exhaust treatment path A passes through the at least one soot filter array 50 or preferably further passes through the at least one catalyst converter array 30, the second exhaust treatment path B passes through the at least one catalyst converter array 30. When the engine exhaust enters the intelligent, full-featured diesel engine exhaust treatment system 1 through the intermediate communicating pipe 10, the microcomputer processor 100 can select an appropriate exhaust treatment path (that is, either the first exhaust treatment path A or the second exhaust treatment path B) for treating the exhaust based on the contaminant levels in the engine exhaust, prior to discharging the exhaust to the atmosphere.

Particularly, the intelligent, full-featured diesel engine exhaust treatment system 1 may further include a path selection regulating valve 90 provided at an appropriate location between the intermediate communicating pipe 10 and the main exhaust pipe 70. The path selection regulating valve 90 can be controlled by the microcomputer processor 100 for selecting to direct the engine exhaust through either the first exhaust treatment path A or the second exhaust treatment path B.

According to the preferred embodiment of this invention, the first exhaust treatment path A in the intelligent, full-featured diesel engine exhaust treatment system 1 sequentially passes through the intermediate communicating pipe 10, the lower collection tube 20, soot filter array 50 (and preferably further passes through the catalyst converter array 30), and the main exhaust pipe 70. The second exhaust treatment path B sequentially passes through the intermediate communicating pipe 10, the catalyst converter array 30, the muffler 80, and the main exhaust pipe 70. The soot filter array 50 preferably includes at least one heating soot filter, and the catalyst converter array 30 preferably includes at least one low temperature catalyst converter to optimize the exhaust treatment effects.

The exhaust detecting device 110 is provided at the intermediate communicating pipe 10 to allow omnibearing and continuous detection of the exhaust data of the engine exhaust prior to entering the first or the second exhaust treatment path, including temperature, pressure, flow rate, light impermeability, and the existence of hydrocarbons, carbon monoxides, sulfides and nitrides.

The measures as to how the, exhaust detecting device 110 detects the exhaust data to allow the microcomputer processor 100 to determine a proper exhaust treatment path are explained as follows.

1. According to the preferred embodiment of this invention, when the exhaust temperature detected by the exhaust detecting device 110 exceeds 250° C., the intelligent, full-featured diesel engine exhaust treatment system 1 would select the second exhaust treatment path B; that is, the engine exhaust would pass through the intermediate communicating pipe 10, catalyst converter array 30, muffler 80, and main exhaust pipe 70 in sequence, and then would be discharged into the atmosphere as treated exhaust. On the other hand, when the exhaust temperature detected by the exhaust detecting device 110 is lower than 250° C., the intelligent, full-featured diesel engine exhaust treatment system 1 would select the first exhaust treatment path A; that is, the engine exhaust would pass through the intermediate communicating pipe 10, lower collection tube 20, soot filter array 50 (or preferably further through the catalyst converter 30), and main exhaust pipe 70 in sequence, and then would be discharged into the atmosphere as treated exhaust.

2. According to the preferred embodiment of this invention, when the pressure of the exhaust system detected by the exhaust detecting device 110 exceeds the maximum allowable pressure of the engine exhaust, the intelligent, full-featured diesel engine exhaust treatment system 1 would select the second exhaust treatment path B; that is, the engine would pass through the intermediate communicating pipe 10, catalyst converter array 30, muffler 80, and main exhaust pipe 70 in sequence, and then would be discharged into the atmosphere as treated exhaust. On the other hand, when the pressure of the exhaust system detected by the exhaust detecting device 110 is lower than the maximum allowable pressure of the engine exhaust, the intelligent, full-featured diesel engine exhaust treatment system 1 would select the first exhaust treatment path A; that is, the engine exhaust would pass through the intermediate communicating pipe 10, lower collection tube 20, soot filter array 50 (or preferably further passing through the catalyst converter 30), and main exhaust pipe 70 in sequence, and then would be discharged into the atmosphere as treated exhaust.

3. According to the preferred embodiment of this invention, when the light impermeability detected by the exhaust detecting device 110 exceeds 20%, the intelligent, full-featured diesel engine exhaust treatment system 1 would select the first exhaust treatment path A; that is, the engine exhaust would pass through the intermediate communicating pipe 10, lower collection tube 20, soot filter array 50 (or preferably further passing through the catalyst converter 30), and main exhaust pipe 70 in sequence, and then would be discharged into the atmosphere as treated exhaust. Other the other hand, when the light impermeability detected by the exhaust detecting device 110 is less than 20%, the intelligent, full-featured diesel engine exhaust treatment system 1 would select the second exhaust treatment path B; that is, the engine would first pass through the intermediate communicating pipe 10, catalyst converter array 30, muffler 80, and main exhaust pipe 70 in sequence, and then would be discharged into the atmosphere as treated exhaust.

4. According to the preferred embodiment of this invention, when the exhaust detecting device 110 detects that the content of hydrocarbons in the engine exhaust exceeds 120 ppm, the intelligent, full-featured diesel engine exhaust treatment system 1 would select the second exhaust treatment path B; that is, the engine exhaust would pass through the intermediate communicating pipe 10, catalyst converter array 30, muffler 80, and main exhaust pipe 70 in sequence, and then would be discharged into the atmosphere as treated exhaust. On the other hand, when the exhaust detecting device 110 detects that the content of hydrocarbons in the engine exhaust is less than 120 ppm, the intelligent, full-featured diesel engine exhaust treatment system 1 would select the first exhaust treatment path A; that is, the engine exhaust would pass through the intermediate communicating pipe 10, lower collection tube 20, soot filter array 50 (or preferably further passing through the catalyst converter 30), and main exhaust pipe 70 in sequence, and then would be discharged into the atmosphere as treated exhaust.

5. According to the preferred embodiment of this invention, when the exhaust detecting device 110 detects that the content of carbon monoxides in the engine exhaust exceeds 300 ppm, the intelligent, full-featured diesel engine exhaust treatment system 1 would select the second exhaust treatment path B; that is, the engine would pass through the intermediate communicating pipe 10, catalyst converter array 30, muffler 80, and main exhaust pipe 70 in sequence, and then would be discharged into the atmosphere as treated exhaust. On the other hand, when the exhaust detecting device 110 detects that the content of carbon monoxides in the engine exhaust is less than 300 ppm, the intelligent, full-featured diesel engine exhaust treatment system 1 would select the first exhaust treatment path A; that is, the engine exhaust would pass through the intermediate communicating pipe 10, lower collection tube 20, soot filter array 50 (or preferably further passing through the catalyst converter 30), and main exhaust pipe 70 in sequence, and then would be discharged into the atmosphere as treated exhaust.

In other words, the exhaust detecting device 110 transmits the exhaust data to the microcomputer processor 100 to allow the microcomputer processor 100 to determine to which of the first exhaust treatment path A or the second exhaust treatment path B the engine exhaust should be selected, for purifying the engine exhaust.

Figure 2:
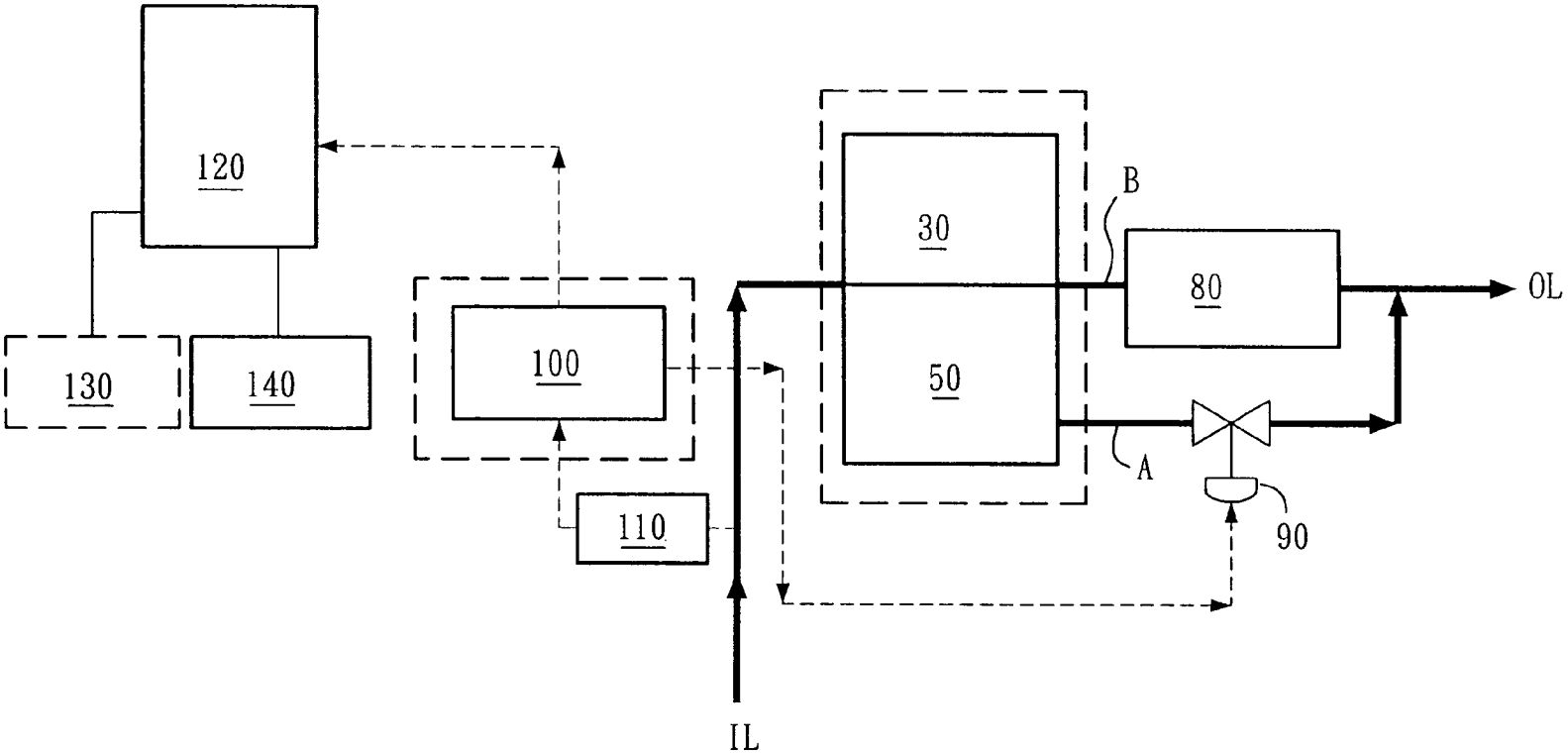
FIG. 2 illustrates a schematic view illustrating the technical concepts of FIG. 1 for treating engine exhaust.
Figure 3:
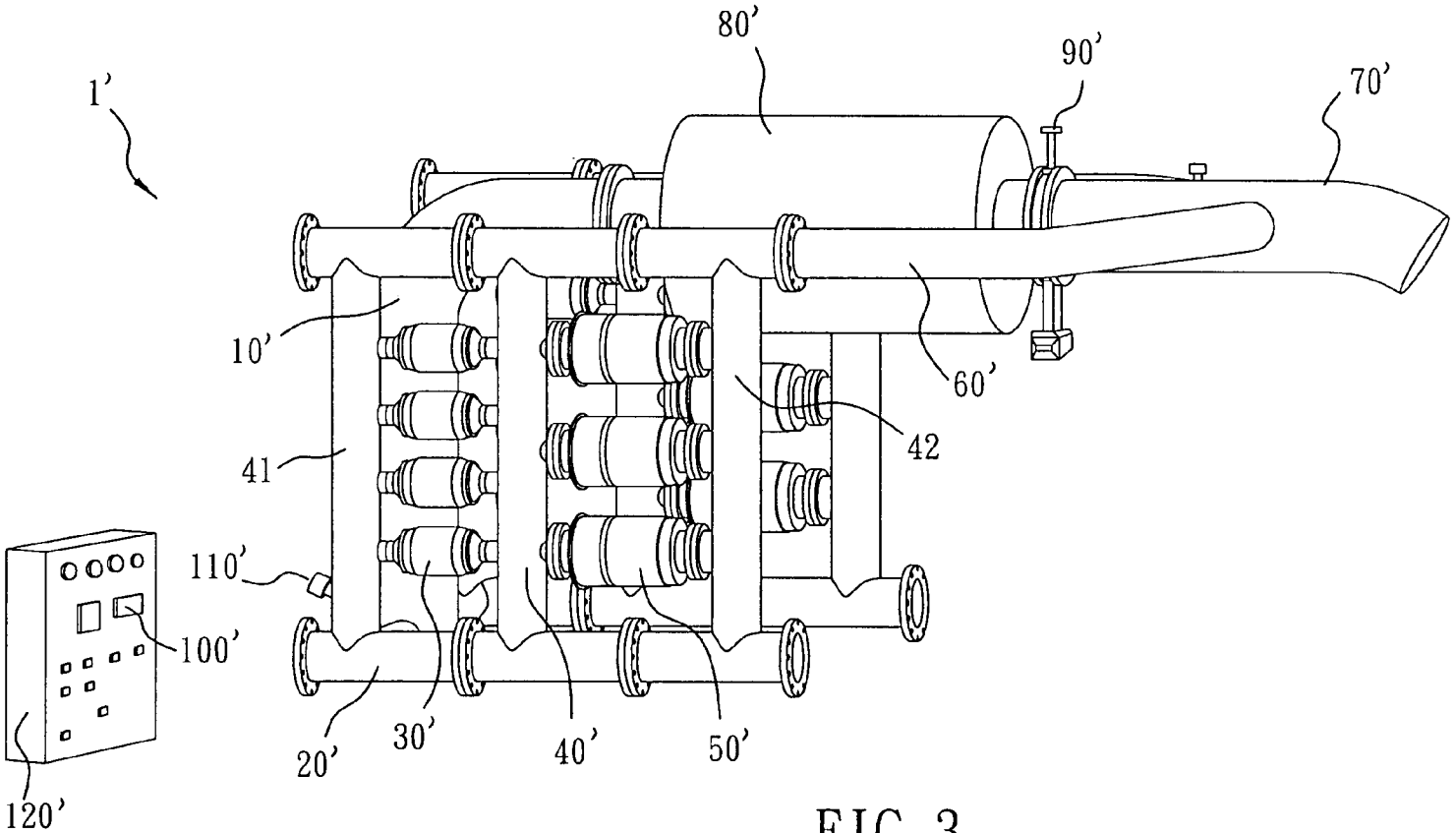
FIG. 3 illustrates a schematic view illustrating an arrangement of an intelligent, full-featured diesel engine exhaust treatment system adopting the technical concepts of FIG. 2 according to another embodiment of this invention in a vertically symmetrical configuration.

FIG. 2 illustrates a flowchart which explains how a proper embodiment of the intelligent, full-featured diesel engine exhaust treatment system 1 of this invention treats the engine exhaust. As shown in FIG. 3, after the engine exhaust is directed into the system through the inlet IL and then to the intermediate communicating pipe 10, the exhaust detecting device 110 would transmit the exhaust data of the engine exhaust to the microcomputer processor 100 for determining to which of the first exhaust treatment path A or the second exhaust treatment path B should the engine exhaust be directed.

If the engine exhaust is directed to the first exhaust treatment path A, it would pass through the soot filter array 50 (preferably further passing through the catalyst converter array 30) via the lower collection tube 20. The soot filter array 50 is connected to a regeneration heater (not shown) and an air pump (not shown) activated by a control panel 120 to allow regeneration at desires. The exhaust is then finally discharged from the outlet OL of main exhaust pipe 70 to the atmosphere after being purified by the catalyst converter array 30 and the soot filter array 50 via the upper collection tube 60.

If the engine exhaust is directed into the second exhaust treatment path B, it would enter the catalyst converter array 30 for exhaust conversion to pass through the muffler 80, and is then discharged from the outlet OL of the main exhaust pipe 70 to the atmosphere. The path selection regulating valve 90 can be provided at an appropriate location between the intermediate communicating pipe 10 and the main exhaust pipe 70. Preferably, the path selection regulating valve 90 is provided between the muffler 80 and the main exhaust pipe 70. The path selection regulating valve 90 is controlled by the microcomputer processor 100 of the intelligent, full-featured diesel engine exhaust treatment system 1. The path selection regulating valve 90 may also be provided between the low temperature catalyst converter array 30 and the muffler 80, as shown in FIG. 2.

In addition, the control panel 120 is preferably controlled by a UPS power source 130 and an emergency power source 140. The control panel 120 may be controlled by a second microcomputer processor (in the control panel, if desired) for automatically selecting the UPS power source or the emergency power source as the power source, thereby preventing shutdown of the intelligent, full-featured diesel engine exhaust treatment system due to abnormality of the regular power source.

FIG. 3 illustrates another embodiment that is constructed in accordance with the technical concepts of this invention in a vertically symmetrical configuration as shown in FIG. 3, the intelligent, full-featured diesel engine exhaust treatment system 1' generally includes: an exhaust flowing zone constructing of plural components 10', 20', . . . , 80', a microcomputer processor 100', and an exhaust detecting device 110' provided between the exhaust flowing zone and the microcomputer processor 100'. A left-side collection tube 41 and a right-side collection tube 42 are provided between the upper collection tube 60' and the lower collection tube 20' and respectively located on the left-hand side and right-hand side of the intermediate collection tube 40'.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

What is claimed is:

1. An intelligent, full-featured diesel engine exhaust treatment system for treating engine exhaust discharged by an engine, including an exhaust flowing zone, wherein the exhaust flowing zone comprises separate elements (A, B, C, and D):

an intermediate communicating pipe (A), for directing the engine exhaust into the exhaust flowing zone;

at least one catalyst converter array (B) to treat hydrocarbon and carbon monoxides in the engine exhaust, said at least one catalyst converter array being directly or indirectly in communication with the intermediate communicating pipe for treating the exhaust from the intermediate communicating pipe;

at least one soot filter array (C) to filter soot particles in the engine exhaust, said at least one soot filter array being directly or indirectly in communication with the intermediate communicating pipe for filtering the engine: exhaust from the intermediate communicating pipe; and a main exhaust pipe (D), being directly or indirectly in communication with the at least one soot filter array and said at least one catalyst converter array for discharging the engine exhaust that has been filtered by the at least one soot filter array or treated by the at least one catalyst converter array to atmosphere, wherein:

the soot filter array and catalyst converter array are respectively and exclusively constructed to carry out filtering of soot and treatment of hydrocarbons in the engine exhaust, the exhaust flowing zone defines a first exhaust treatment path and a second exhaust treatment path, both the first exhaust treatment path and the second treatment path extending between the intermediate communicating pipe and the main exhaust pipe, the first exhaust treatment path sequentially passes through the intermediate communicating pipe, the at least one soot filter array, and the main exhaust pipe; and the second exhaust treatment path sequentially passes though the intermediate communicating pipe, the at least one catalyst converter array, and the main exhaust pipe;

and wherein: the exhaust flowing zone is provided with an exhaust detecting device at an appropriate location for detecting engine exhaust, whereby after the engine exhaust enters the intelligent, full-featured diesel engine exhaust treatment system through the intermediate communicating pipe, a microcomputer processor of the intelligent, full-featured diesel engine exhaust treatment system determines to which of the first exhaust treatment path or the second exhaust treatment path should the engine exhaust be directed based on the engine exhaust data, prior to discharging the engine exhaust into the atmosphere.

2. The intelligent, full-featured diesel engine exhaust treatment system of claim 1, wherein the second exhaust treatment path further comprises a muffler, being in communication with the at least one catalyst converter array and receiving the engine exhaust that has been treated by the at least one catalyst converter array, for reducing noises prior to discharging the engine exhaust into the atmosphere.

3. The intelligent, full-featured diesel engine exhaust treatment system of claim 1, wherein the first exhaust treatment path includes at least one catalyst converter array for treating the engine exhaust in the first exhaust treatment path.

4. The intelligent, full-featured diesel engine exhaust treatment system of claim 1, wherein the first exhaust treatment path includes at least one lower collection tube, for directing the engine exhaust from the intermediate communicating pipe to other components in the first exhaust treatment path.

5. The intelligent, full-featured diesel engine exhaust treatment system of claim 2, wherein the first exhaust treatment path includes at least one upper collection tube, for directing the engine exhaust that has been treated in the first exhaust treatment path to the main exhaust pipe.

6. The intelligent, full-featured diesel engine exhaust treatment system of claim 1, further comprises at least one intermediate collection tube, for establishing communication between the at least one catalyst converter array with the at least one soot filter array.

7. The intelligent, full-featured diesel engine exhaust treatment system of claim 1, wherein the at least one catalyst converter array is constructed of 1 to 20 low temperature catalyst converters.

8. The intelligent, full-featured diesel engine exhaust treatment system of claim 1, wherein the at least one soot filter array is constructed of 1 to 20 heating soot filters.

9. The intelligent, full-featured diesel engine exhaust treatment system of claim 1, further comprising: a path selection regulating valve, the path selection regulating valve being controlled by the microcomputer processor for selecting to which of the first exhaust treatment path or the second exhaust treatment path should the engine exhaust be directed.

10. The intelligent, full-featured diesel engine exhaust treatment system of claim 1, wherein the soot filter array is connected to a regeneration heater and an air pump activated by a control panel to allow regeneration at desire.

11. The intelligent, full-featured diesel engine exhaust treatment system of claim 1, wherein the system includes a power supply connected to a UPS power source and an emergency power source, the power supply being controlled by a second microcomputer processor for automatically selecting the UPS power source or the emergency power source as the power source, thereby preventing shutdown of the intelligent, full-featured diesel engine exhaust treatment system due to abnormality of regular power source.

12. The intelligent, full-featured diesel engine exhaust treatment system of claim 1, wherein when the temperature of the exhaust system detected by the exhaust detecting device exceeds the 250 Celsius degree, the intelligent, full-featured diesel engine exhaust treatment system would select the second exhaust treatment path, and when the temperature of the exhaust system detected by the exhaust detecting device is lower than 250 Celsius degree, the intelligent, full-featured diesel engine exhaust treatment system would select the first exhaust treatment path.

13. The intelligent, full-featured diesel engine exhaust treatment system of claim 1, wherein when the pressure of the exhaust system detected by the exhaust detecting device exceeds the maximum allowable pressure of the engine exhaust, the intelligent, full-featured diesel engine exhaust treatment system would select the second exhaust treatment path, and when the pressure of the exhaust system detected by the pressure detecting device is lower than the maximum allowable pressure of the engine exhaust the intelligent, full-featured diesel engine exhaust treatment system would select the first exhaust treatment path.

14. The intelligent, full-featured diesel engine exhaust treatment system of claim 1, wherein when the light impermeability detected by the exhaust detecting device exceeds 20%, the intelligent, full-featured diesel engine exhaust treatment system would select the first exhaust treatment path, and when the light impermeability detected by the exhaust detecting device is less than 20%, the intelligent, full-featured diesel engine exhaust treatment system would select the second exhaust treatment path.

15. The intelligent, full-featured diesel engine exhaust treatment system of claim 1, wherein when the content of the hydrocarbon detected by the exhaust detecting device exceeds 120 ppm, the intelligent, full-featured diesel engine exhaust treatment system would select the second exhaust treatment path, and when the content of the hydrocarbon detected by the exhaust detecting device is less than 120 ppm, the intelligent, full-featured diesel engine exhaust treatment system would select the first exhaust treatment path.

16. The intelligent, full-featured diesel engine exhaust treatment system of claim 1, wherein when the content of the carbon monoxide detected by the exhaust detecting device exceeds 300 ppm, the intelligent, full-featured diesel engine exhaust treatment system would select the second exhaust treatment path, and when the content of the hydrocarbon detected by the exhaust detecting device is less than 300 ppm, the intelligent, full-featured diesel engine exhaust treatment system would select the first exhaust treatment path.

17. The intelligent, full-featured diesel engine exhaust treatment system of claim 1, wherein the array of soot fillers contain no catalyst converters and the array of catalyst converters no soot fillers.

* * * * *